United States Patent [19]

Simko et al.

[11] 4,208,995

[45] Jun. 24, 1980

[54] FUEL INJECTION FUEL FLOW CONTROL SYSTEM

[75] Inventors: Aladar O. Simko; Michael A. Choma, both of Dearborn Heights; Michael M. Schechter, Southfield, all of Mich.

[73] Assignee: Ford Motor Company, Dearborn, Mich.

[21] Appl. No.: 966,971

[22] Filed: Dec. 6, 1978

[51] Int. Cl.[2] ..... F02M 25/06

[52] U.S. Cl. ..... 123/119 A

[58] Field of Search ..... 123/119 A, 32 EE

[56] References Cited

U.S. PATENT DOCUMENTS 4,163,435 8/1979 Nakajima et al. ..... 123/119 A

FOREIGN PATENT DOCUMENTS 2247451 4/1974 Fed. Rep. of Germany ..... 123/119 A

*Primary Examiner*—Wendell E. Burns

*Attorney, Agent, or Firm*—Robert E. McCollum; Clifford L. Sadler

[57] ABSTRACT

FIGS. 1*a,* 1*b,* 1*c,* 1*d,* and 1*e* collectively schematically illustrate a fuel injection control system for an internal combustion engine having a fuel pump 38 that has a fuel flow output that varies as a direct function of engine speed, an air/fuel ratio controller 100 that has a mechanical linkage that varies the output of pump 38 as a function of changes in engine intake manifold vacuum acting on an aneroid 122 to maintain a constant air/fuel ratio to the engine mixture charge, and a linkage type regulator with five vacuum controlled motors 156, 170, 178, 186 and 190, that modify the position of the regulator 100 in a step-wise progressive and sequential manner to establish exhaust gas recirculation (EGR) and to change fuel flow to compensate for the change in oxygen concentration in the mixture charge due to EGR flow and other engine operating conditions as well as engine operating temperature changes.

30 Claims, 6 Drawing Figures

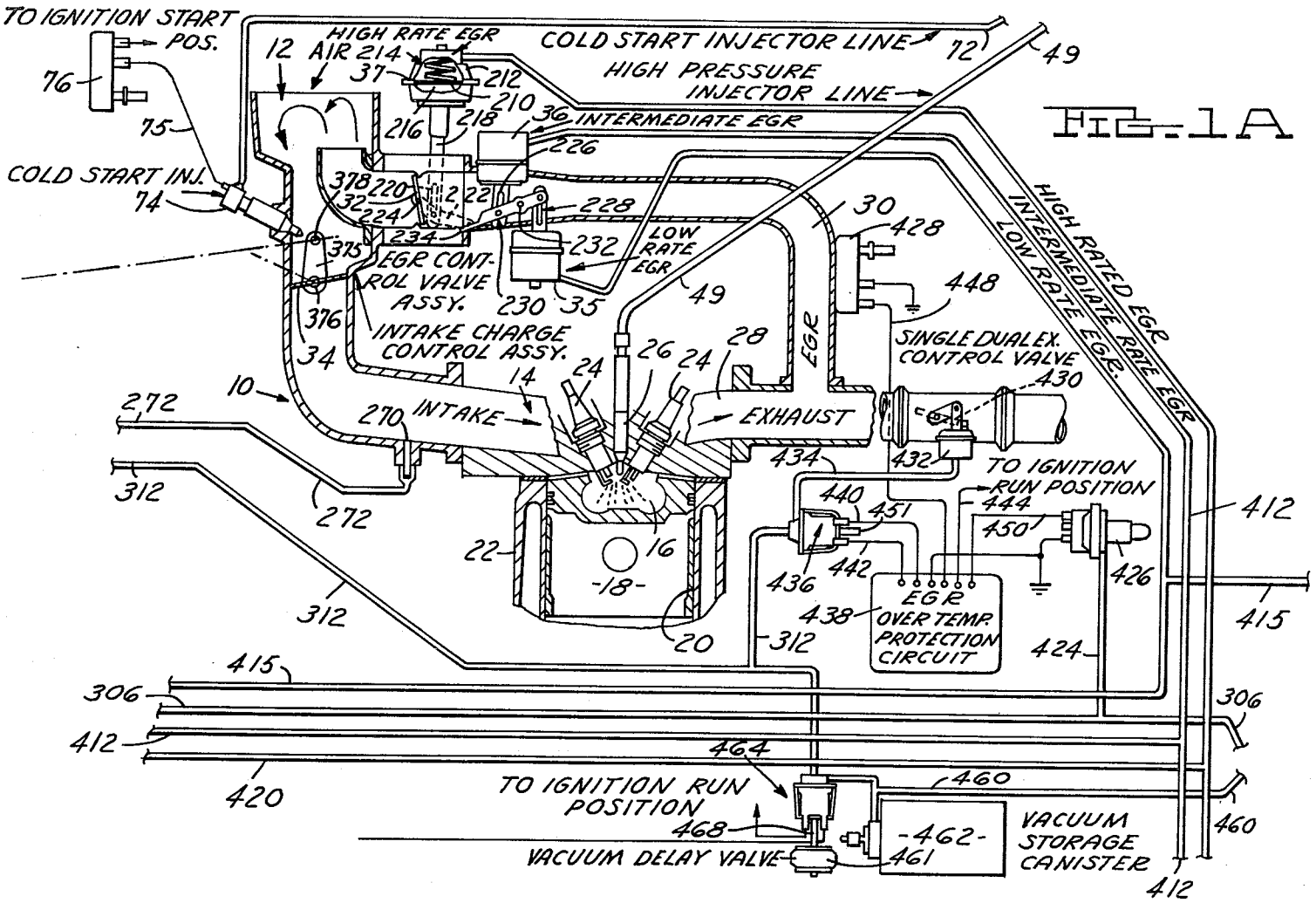
HG-1A

Figure 1B:
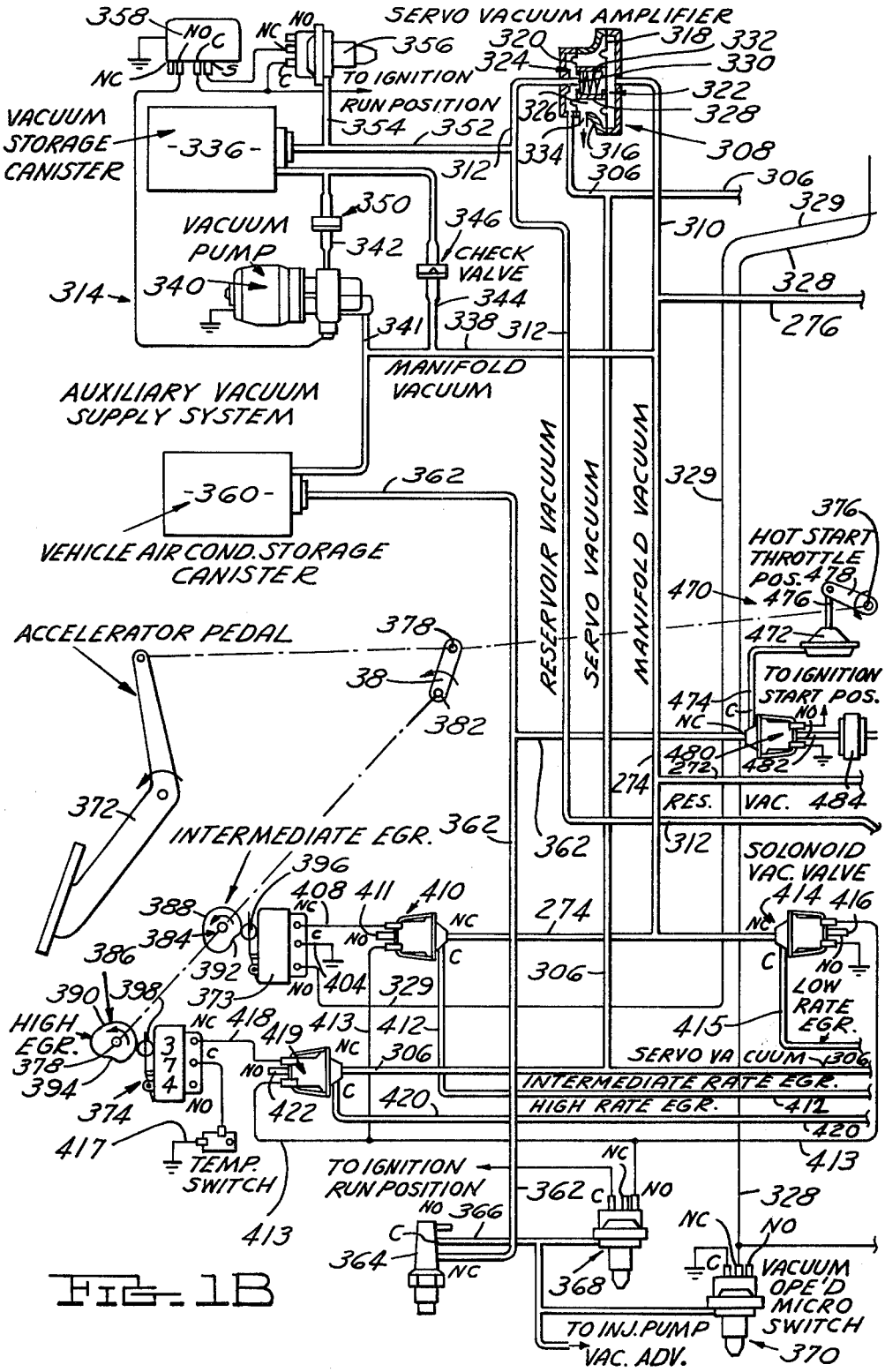
Figures 1C, 2:
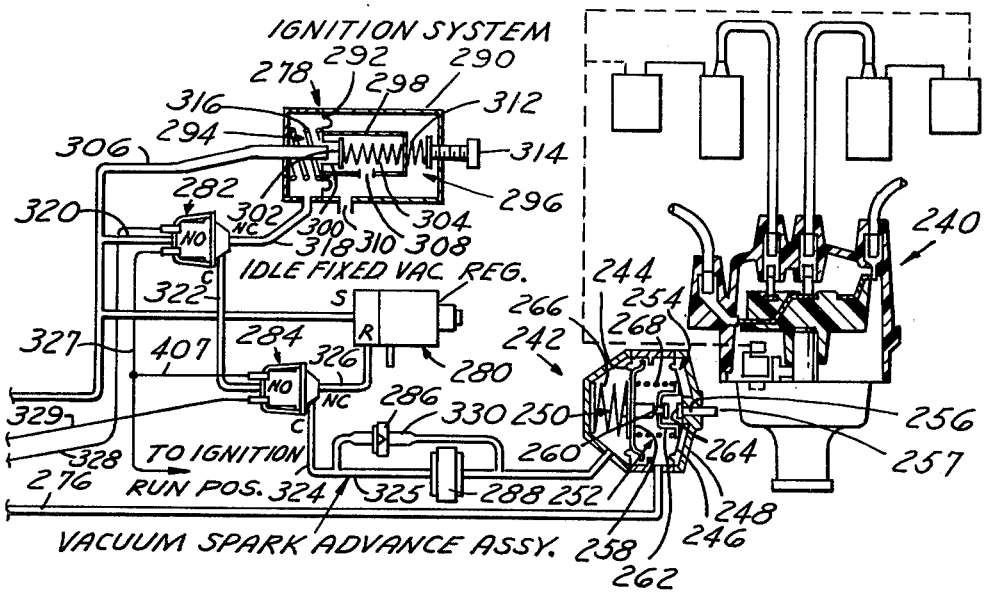
Figure 1D:
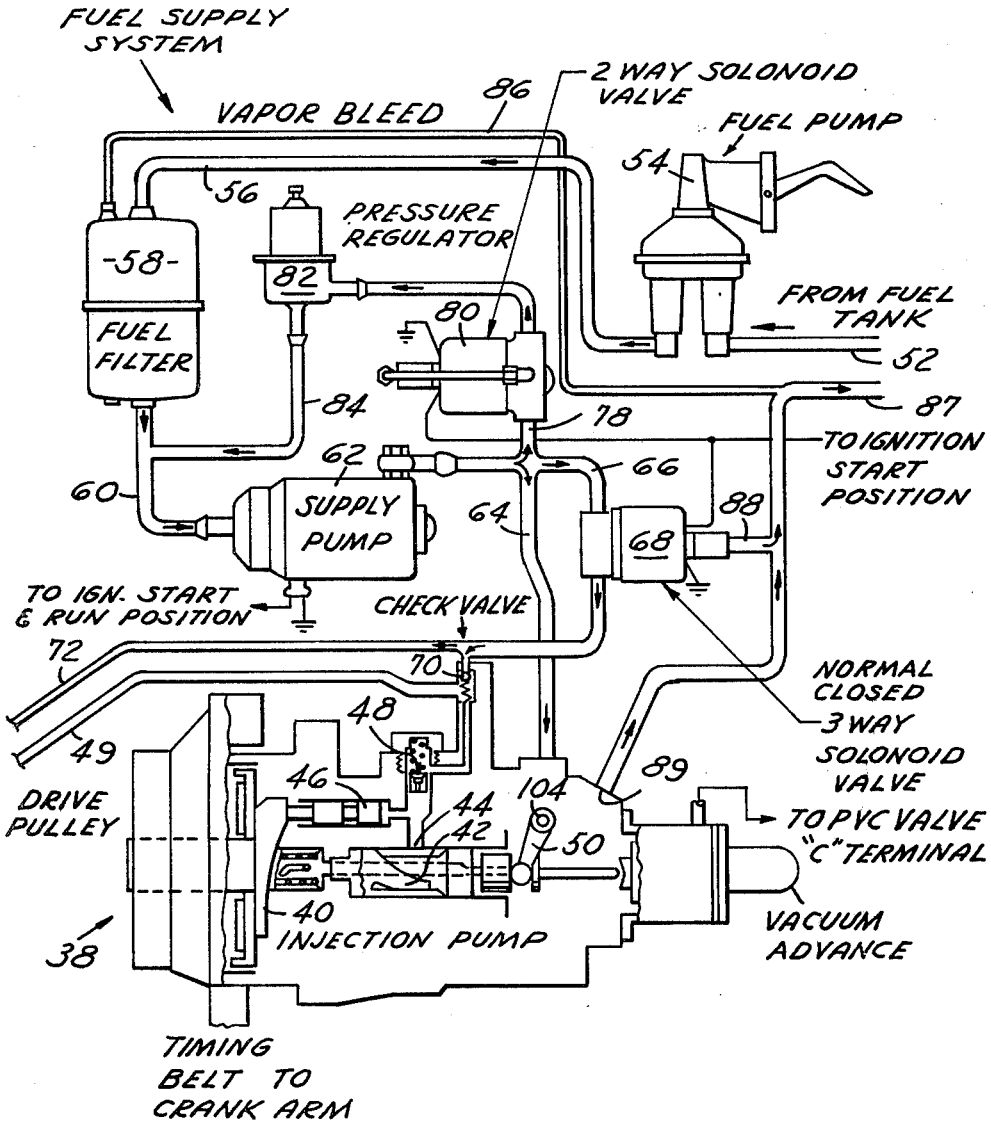
Figure 1E:
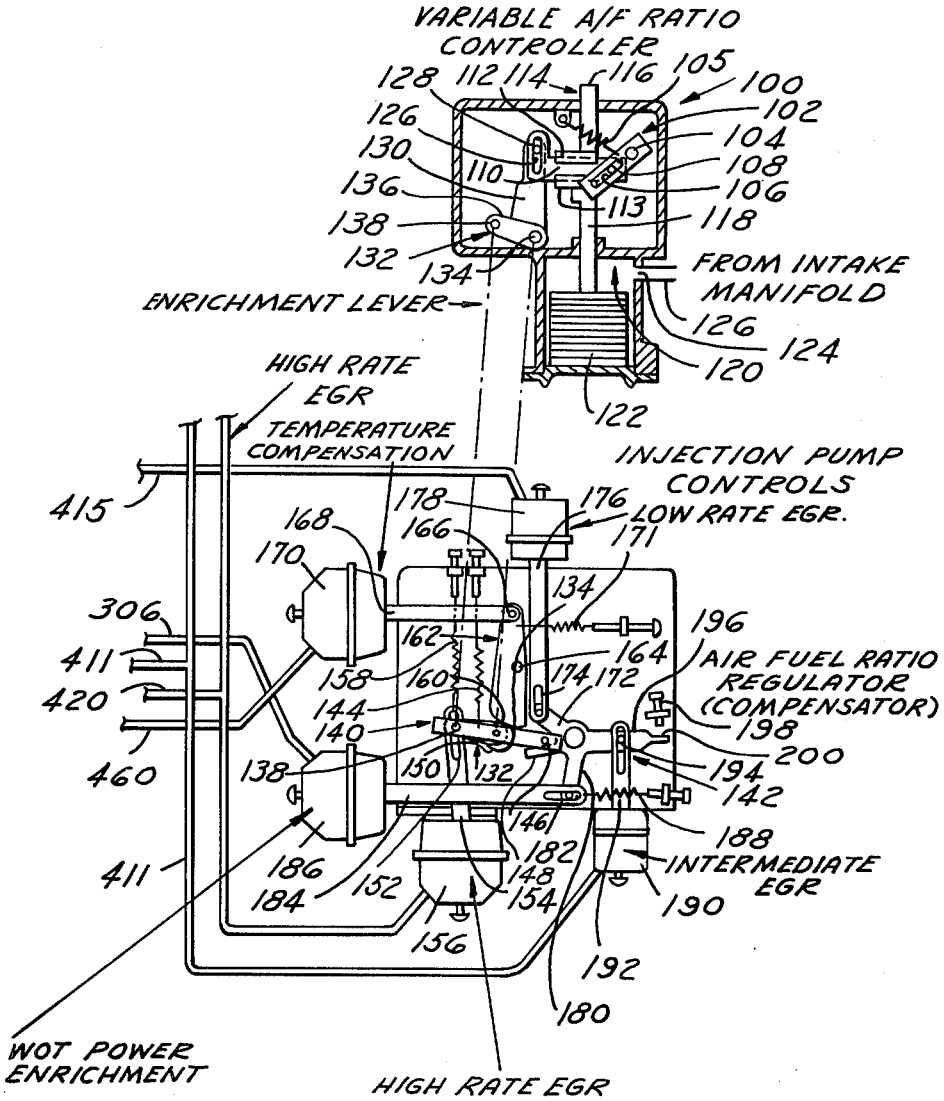

| | | |
|---|---|---|
| FIG. 1B | FIG. 1C | FIG. 1D |
| | FIG. 1A | FIG. 1E |

FUEL INJECTION FUEL FLOW CONTROL SYSTEM

This invention relates in general to an internal combustion engine of the spark ignition, stratified charge, fuel injection type. More particularly, it relates to a fuel injection control system for such an engine that will establish and maintain desired air/fuel ratios to the mixture charge in the engine combustion chamber for different engine operating conditions.

U.S. Pat. No. 3,696,798, Bishop et al, shows and describes a combustion process for a stratified charge, fuel injection type internal combustion engine in which a particular air/fuel ratio of the mixture charge is established, and that ratio is maintained constant during engine idle and part throttle operating conditions to obtain good emission control and fuel econony, even with the addition of exhaust gas recirculation (EGR) to control $No_x$ emission levels.

Copending U.S. patent application Ser. No. 928,213, Fuel Injection Pump Assembly, filed July 26, 1978, and having the same assignee as of this application, shows and describes a fuel injection pump having a face cam type pumping member that is contoured to provide a fuel flow output that matches mass air flow changes over the entire engine speed and load operating range to provide a constant mixture charge air/fuel ratio.

Copending U.S. patent application Ser. No. 937,693, Air/Fuel Ratio Controller, filed Aug. 29, 1978, also having the same assignee as of this application, is directed to an air/fuel ratio controller or regulator that provides a mechanical linkage, vacuum controlled mechanism to maintain the constant air/fuel ratio described above in connection with the two devices described regardless of changes in engine intake manifold vacuum, intake manifold gas temperature, and the flow of exhaust gases to control $No_x$ levels.

It is an object of this invention to provide a control system that will regulate the movement of an air/fuel ratio controller of the type in U.S. Ser. No. 937,693 to control the movement of the fuel pump fuel output control lever of an injection pump of the type in U.S. Ser. No. 928,213 to provide the constant air/fuel ratio to the mixture charge called for, or to provide other air/fuel ratios as required for other operating conditions of the engine.

More specifically, this invention is directed to a fuel injection fuel control system that first controls the fuel flow output from a fuel injection pump in a manner to maintain certain air/fuel ratios to the mixture charge regardless of changes in engine intake manifold vacuum levels, or the recirculation of exhaust gases, or changes in the engine coolant temperature, while, however, providing for changes to obtain maximum acceleration, or establish idle speed or engine decelerating conditions; secondly, that establishes other air/fuel ratios to the mixture charge; and, thirdly, that coordinates the engine ignition timing not only with the opening of the engine throttle valve, but also with the flow of exhaust gases to compensate for any changes in burn rate and other effects.

Fuel injection pump assemblies are known that attempt to automatically maintain some kind of air/fuel ratio control in response to changes in air temperature and air pressure, as well as exhaust back pressure. For example, U.S. Pat. No. 2,486,816, Beeh, Fuel Mixture Control for Internal Combustion Engines, shows in FIG. 10 a control system for a pair of fuel injection pumps in which the fuel flow output is automatically varied as a function of changes in engine intake manifold vacuum level, manual settings, and intake temperature and exhaust pressure levels. U.S. Pat. No. 2,989,043, Reggio, Fuel Control System, shows in FIG. 6 a mechanical-vacuum system in which a particular air/fuel ratio is chosen by movement of a manual lever 78, that ratio being maintained even though changes occur in air temperature and manifold vacuum levels. FIG. 10 shows the use of such a system with a fuel injection pump 104.

Neither of the above devices, however, operate to provide the finite control of the air/fuel ratio that is provided by this invention, as will be described later, to not only provide a constant base air/fuel ratio, but also means to modify or vary the base ratio to establish other ratios that are more in accordance with selected operating conditions of the engine, to provide better emission control and better fuel ecomony. Also, neither of the above devices shows any control for modifying the fuel output to compensate for the addition of exhaust gases to control $No_x$ levels.

It is another object of this invention to provide a control system that effects movement of an EGR valve, changes the engine ignition timing, and also regulates the movement of an air/fuel ratio controller that regulates the fuel pump fuel output, the above controlled as a function of movement of the vehicle accelerator pedal and microswitches that selectively establish various operating conditions of the engine.

It is a still further object of the invention to provide a fuel injection control system in which selected air/fuel ratios of the mixture charge flowing to the engine combustion chamber normally are maintained constant, regardless of changes in engine speed, by an air/fuel ratio controller or regulator that changes the fuel pump output in response not only to changes in mass air/flow as indicated by changes in engine manifold vacuum, but also in response to changes in the concentration of oxygen in the mixture charge upon the addition or deletion of EGR gases to control $No_x$ emissions.

It is another object of the invention to provide a control system of the type described above in which a stepwise change in fuel pump output is provided in response to step-wise establishment of the various flow rates of EGR gases to provide a finite schedule of the flow of EGR gases.

Other objects, features and advantages of the invention will become apparent upon reference to the succeeding detailed description thereof, and to the drawings illustrating the preferred embodiment thereof; wherein, FIGS. 1*a*, 1*b*, 1*c*, 1*d*, and 1*e* each represent schematically a one-fifth portion of a fuel injection control system embodying the invention, the system being shown as a whole when the sheets containing FIGS. 1*a*, 1*b*, 1*c*, 1*d*, and 1*e* are assembled contiguously in the manner indicated in FIG. 2.

FIGS. 1*a*, 1*b*, 1*c*, 1*d*, and 1*e* together illustrate schematically only those portions of the induction and exhaust system of a fuel injection type internal combustion engine to which the control system of the invention relates, as the remaining details of construction of the engine are known and believed to be unnecessary for an understanding of the invention.

More specifically, the system as seen in FIG. 1*a* includes an air-gas (air+EGR) intake manifold induction passage 10 that is open at its upper end 12 to air at essentially atmospheric or ambient pressure level from the clean air side of a conventional dry element type air cleaner, not shown. The induction passage is directed at its opposite or lower end 14 to discharge through valving not shown into a swirl or bowl type combustion chamber indicated schematically at 16. The chamber in this case is formed in the top of a piston 18 slidably mounted in the bore 20 of a cylinder block 22.

The combustion chamber 16 has a pair of symmetrically arranged spark plugs 24 for the ignition of the intake mixture charge formed from the gas in induction passage 10 and the fuel injected from an injector 26.

An exhaust gas conduit 28 has a branch passage 30 that is adapted to recirculate a portion of the exhaust gases past an EGR valve 32 to a point near the inlet 12 to induction passage 10 and above a conventional pivotally movable throttle valve 34. Thus, movement of throttle valve 34 provides a total control of the mass flow of gas into the engine cylinder. The EGR valve 32 is rotatable in steps in a manner to be described by three servo mechanisms or motors 35, 36, 37 to provide stepwise establishment of different flow rates of exhaust gases during selected load periods of operation of the engine.

As seen in FIG. 1*d*, the fuel delivered to injector 26 is supplied by an engine driven fuel injection pump 38 of the plunger type shown and described more fully in application U.S. Ser. No. 928,213 referred to above. The pump has a right angled cam face 40 that is contoured to match fuel pump output with the mass air flow characteristics of the engine for all engine speed and load conditions of operation so a constant air/fuel ratio to the mixture charge flowing into the engine combustion chamber 16 normally will be maintained at all times. The pump rotates an axially movable fuel metering sleeve valve having a helix 42 that cooperates with a spill port 44 to block the same at times for a predetermined duration. This will permit the output from a plunger 46 of the pump to build up in pressure against a delivery valve 48 to open the same and supply fuel through a main fuel line 49 to the injector 26. Axial movement of the pump helix 42 by a fuel flow control lever 50 will vary the base fuel flow output by blocking or unblocking the spill port 44 for different durations of time.

The fuel supply system for pump 38 is also shown in FIG. 1*d*. It includes a fuel supply line 52 that connects a conventional gasoline tank, not shown, to the inlet of an engine driven mechanical type fuel pump indicated at 54. Pump 54 has a low pressure output line 56 that passes fuel through a filter 58 to the inlet line 60 of a supply pump 62 to prime the same. The latter pump is electrically driven and connected to the engine ignition circuit as indicated so as to be energized at all times when the vehicle ignition key is in either the engine ignition "start" or "run" positions. The pump 62 supplies fuel normally at a pressure of 28 psi directly to the inlet of injection pump 38 through a line 64. It also supplies fuel to a second controlled line 66 having a three-way solenoid operated valve 68.

Valve 68 is normally closed and electrically connected to the engine ignition system as indicated to be energized to unblock line 66 only when the ignition key is in the "start" position. Fuel is then supplied past a check valve 70 to the delivery valve 48 of injection pump 38 to prime the pump, and also through a cold start injector line 72 to an electrically opened fuel injector 74.

The injector 74 is used only for cold starts to supply the additional fuel needed at this time to start the engine. The supply of current to the injector 74 is controlled by a wire 75 to an on-off type temperature responsive switch 76 that also is electrically connected to the ignition system. The switch closes the circuit to the injector upon start-up of the engine, and then only if the engine operating temperature is below a predetermined level. The start-up of a warm engine does not require the injection of additional fuel.

Fuel pump 62 supplies more fuel to lines 64, 66 than is needed by the system to satisfy fuel requirements. The excess fuel is bypassed into a return line 78 that leads back to the inlet 60 of supply pump 62 past a two-way solenoid operated valve 80 and a pressure regulator 82. Valve 80 normally is spring opened, but is electrically connected to the "start" position of the ignition circuit, as indicated, to close at the time the engine is started to raise the fuel pump backpressure to 100 psi. This will be high enough to prime the pump 38 and to furnish enough fuel pressure to actuate the cold start injector 74. As soon as the starting circuit is de-energized, valve 80 will again open to its normal position. Pressure regulator valve 82 is conventional and included in bypass line 78 to maintain the pressure in line 64 to approximately 28 psi, for example. The other side of the pressure regulator valve will discharge the excess fuel through a line 84 to pump inlet line 60 at a low pressure of approximately 5–7 psi, for example.

The fuel filter 58 has a vapor bleed line 86 that is connected to a main fuel tank return line 87. The latter is connected both to the vent line 88 of the three-way solenoid valve 68 and also to the outlet 89 of fuel injection pump 38.

The operation of the fuel supply system, in brief, is as follows. When the ignition key is turned to the start position, the two-way solenoid valve 80 closes blocking line 78, supply pump 62 is energized to close its contacts, fuel pump 54 is cranked, and the three-way solenoid valve 68 opens, blocking vent line 88. Pump 62, therefore, supplies fuel under a pressure of approximately 100 psi for start-up purposes through line 66 to the cold start injector line 72 for the injection of a predetermined amount of fuel into the induction passage 10. If the engine is warm when started, temperature switch 76 will break the circuit to injector 74 and prevent the injector from opening. Simultaneously, fuel will be supplied past the one-way check valve 70 into the high pressure injection line 49 for priming the same.

As soon as the engine reaches a running condition and the ignition key is returned to the engine "on" position, the ignition start circuit will be de-energized. This will permit the spring closure of the three-way solenoid valve 68 to vent cold start injection line 72 to drain line 88, and the spring opening of bypass valve 80. This will condition the fuel supply system to operate in its normal or conventional manner with the engine mounted fuel pump 54 supplying fuel under low pressure to the inlet of the supply pump 62. Further details of construction and operation of the various components of the fuel supply system are not given since they are known and believed to be unnecessary for an understanding of the invention. All of the components described are readily purchasable.

FIG. 1*e* shows an air/fuel ratio controller or regulator 100 that is connected to the fuel injection pump lever 50. The function of the regulator is to control the fuel pump fuel flow rate or output as a function of manifold vacuum changes (air flow changes) upon opening of throttle valve 34 so that the air/fuel ratio of the mixture charge flowing to the engine cylinder will remain essentially constant for all engine speed and load changes except wide open throttle. The movement of the regulator 100 by manifold vacuum is modified upon the addition of EGR gases to the intake charge, upon operation of the engine below a predetermined temperature level, as well as upon the occurrence of other events that will be described, each of which changes the oxygen concentration in the intake mixture charge.

The regulator 100 is a vacuum controlled, mechanical linkage mechanism that includes an arcuately movable fuel control lever 102. Lever 102 rotates a shaft 104 on which is fixed the fuel injection pump lever 50 pivotally connected to metering sleeve valve helix 42. Counterclockwise movement of lever 102, therefore, will cause a rightward movement of the pump helix 42 to increase the fuel flow output or rate of flow. A spring 105 anchored to the regulator housing normally biases the fuel control lever 102 in a clockwise direction to position helix 42 in a minimum or base fuel flow rate position.

The lever 102 is formed with an elongated cam slot 106 through which projects a roller 108 that is mounted in a cross slide 110. The cross slide is mounted for movement within a channel 112 formed in a cross slide guide 113. The guide is adjustably connected and mounted on a movable rod or shaft 114. Shaft 114 has one end 116 slidably mounted in the housing. Its other end 118 projects through the housing into an engine manifold vacuum sensitive chamber 120 for attachment to the end of a metallic bellows type aneroid 122. The aneroid is sealed with vacuum inside and subjected to the changes in intake manifold vacuum admitted to chamber 120 through an inlet 124 connected by tubing 126 to the intake manifold 10. The changes in manifold vacuum level change the length of the aneroid to move the shaft 114 causing roller 108 to pivot the fuel control lever 102.

The cross slide 110 has formed on its left end an elongated cam slot 126 within which moves a floating roller 128. The roller is pivotally attached to one arm 130 of a fuel enrichment control bellcrank lever 132. Lever 132 is pivotally mounted at 134 on the housing and has a second right angled leg portion 136. A spring not shown normally biases the enrichment lever 132 in a clockwise direction as seen in FIG. 1*e* to a maximum enrichment position moving the fuel lever 102 to a maximum engine acceleration position providing the maximum rate of pump fuel flow.

Movement of the fuel enrichment lever 132 modifies movement of the fuel control lever 102 by the aneroid 122 to compensate for changes in oxygen concentration of the mixture charge caused by such events as EGR flow and operation of the engine below predetermined temperature levels, i.e., a cold engine, which changes the air density of the charge. More specifically, the lower portion of FIG. 1*e* shows the compensating control linkage that is contained in a plane that overlies the plane of the regulator indicated at 100, for moving the lever 132. The linkage contains a walking beam 140 and a bellcrank lever 142.

The walking beam 140 is supported at one end by a spring 144 with the other end containing a cam type pin 146. The latter rests against an angled extension 148 of bellcrank lever 142 to constitute a pivot at times. A roller 150 is mounted on the walking beam 140 to be actuated to move the beam. The pin or pivot 138 of fuel enrichment lever 132 is pivotally fixed to the opposite end of the walking beam and projects through an elongated cam slot 152 of a rod 154 of a high rate EGR vacuum servo 156. Upon application of vacuum, servo rod 154 moves downwardly a predetermined stroke or distance against the bias of an adjustable spring 158 to pull the end of the walking beam 140 in the same fuel leaning direction. The lost motion connection permits independent movement of the walking beam by other servo motors to be described.

The roller 150 on the walking beam 140 is adapted to be engaged by the face 160 of a cam 162 pivoted at 164. The cam is pivotally connected at its upper end 166 to the rod 168 of a temperature compensating vacuum controlled servo motor 170. Stroking of servo motor 170 will pivot the cam 162 against the bias of an adjustable spring 171 to change the position of the roller 150. This will move the pin 138 of enrichment lever 132, resulting in a change in the output of the fuel pump.

The bellcrank lever 142 has an upper leg 172 pivotally connected by a pin and elongated slot type connection 174 to the rod 176 of a low rate EGR vacuum controlled servo motor 178. A servo spring, not shown, normally biases rod 176 toward the servo motor 178. A downwardly projecting leg 180 of bellcrank lever 142 also has a pin and slot type connection 182 to the rod 184 of a wide open throttle (WOT) power enrichment vacuum servo motor 186. An adjustable spring 188 biases the rod towards the right as shown. Finally, an intermediate rate EGR vacuum controlled servo motor 190 has a movable rod 192 connected by a pin and slot type connection 194 to a further leg portion 196 of bellcrank lever 142. Again, a servo spring, not shown, biases the rod 192 towards servo motor 190. An adjustable stop 198 is provided for engagement with the end 200 of bellcrank lever 142.

The mechanism just described provides for a stepwise correction of the position of controller fuel control lever 102 by the progressive actuation of the three separate EGR rate vacuum motors 178, 190, 156 described in sequence with the operation of the corresponding EGR servo motors 35, 36 and 37. Controls to be described are provided whereby opening of the throttle valve 34 will effect this progressive and sequential actuation of the EGR servo motors 35, 36 and 37 to sequentially open the EGR valve to predetermined positions establishing low, intermediate, and high EGR flow rates. Simultaneously, the air/fuel ratio regulator fuel lever 102 is moved by the regulator low, intermediate, and high EGR rate servo motors 178, 190 and 156 to automatically correct the fuel flow for the change in concentration of air as a result of EGR flow.

More specifically, FIG. 1*a* illustrates the low, intermediate, and high EGR flow rate servo motors 35, 36 and 37. The internal construction of the three motors, as well as the regulator servo motors 178, 190, and 156, is essentially the same; therefore, the details of only one will be described. The high EGR flow rate vacuum motor 37 has an annular diaphragm 210 that divides the servo housing 212 into a vacuum chamber 214 and an atmospheric vent chamber 216. A rod 218 attached to the diaphragm projects from the servo housing for a lost motion pin and slot type pivotal connection 220 to a central portion of a bellcrank lever 222. The latter is fixed to the shaft 224 of the EGR valve 32. The intermediate and low rate servo motors 36 and 35 also have lost motion pin and slot type connections 226 and 228, respectively, to the ends of a link 230. The link has a central pivot 232 and a finger end 234 that abuts and actuates the end of lever 222.

The application of vacuum to low, intermediate and high EGR flow rate servo motors 35, 36, and 37 will retract their rods to pivot the link 230 and lever 222 in succession to progressively open the EGR valve 32 in a step-wise manner. The servo springs normally urge the rods outwardly to the positions shown closing the EGR valve. It should be noted that each servo motor 35, 36, 37 will have a different stroke to provide the desired sequential and progressive EGR valve opening and closing.

FIG. 1*c* shows an ignition system having a known type of engine ignition timing distributor 240. It has the usual pivotally mounted adjustable plate or movable magnets, as the case may be, not shown, movable in opposite directions for controlling advance and retard of the engine ignition timing from an initial setting. A vacuum controlled servo actuator 242 is adapted to be connected to the movable plate or magnets for automatically adjusting the ignition timing in accordance with the various operating conditions of the engine.

More specifically, the actuator 242 is of the dual diaphragm type having a pair of spaced annular flexible diaphragms 244 and 246. The latter define with the housing 248 a servo vacuum chamber 250, a manifold vacuum chamber 252, and an air chamber 254. The air chamber is connected to atmosphere through an opening 256 in the housing. A rod 257 extends loosely through opening 256 and is connected at one end to diaphragm 246. Its other end would be connected directly to the adjustable element of the distributor for moving the same in the opposite directions described.

The two diaphragms 244 and 246 are interconnected as shown for a limited axial relative movement between. A retainer 258 fixed to diaphragm 244 mounts a yoke portion 260 that is slidably received within a cup shaped retainer 262 fixed to diaphragm 246. The construction permits a lost motion independent movement of diaphragm 244 leftwardly relative to diaphragm 246 and vice versa until the portion 260 engages the retainer 262. In the opposite direction, yoke 260 will abut the button like end 264 of rod 257. A first spring 266 biases both diaphragms rightwardly to provide an initial engine start and wide open throttle retarded ignition timing setting when manifold and servo vacuums in chambers 252 and 250 are essentially zero. A second spring 268 lightly separates the diaphragms and urges diaphragm 246 rightwardly.

The introduction of servo vacuum to rear chamber 250 will cause the two diaphragms to move leftwardly as a unit progressively to advance the ignition timing by a predetermined amount. A change in manifold vacuum in chamber 252 will permit the atmospheric pressure in chamber 254 to collapse the spring 268 and move diaphragm 246 leftwardly relative to diaphragm 244 and the retainer 262 relative to yoke 260 to provide the main control of the timing advance or retard, as the case may be.

Manifold vacuum communicated to the chamber 252 is connected to the engine intake manifold 10 by a port 270 and by a number of interconnected vacuum lines or passages 272, 274, and 276. Servo vacuum communicating with chamber 250 is controlled by a number of mechanically operated vacuum regulators 278 and 280, a pair of spring closed solenoid opened vacuum flow control valves 282 and 284, and a vacuum delay assembly including a one-way check valve 286 and a flow restricting orifice type valve 288.

The two regulators 278 and 280 are of like construction and are vacuum reducer valves. The details of construction of only one will be given. Regulator 278 consists of a housing 290 having an annular flexible diaphragm 292 partitioning the housing into a vacuum chamber 294 and an air chamber 296. A C clamp shaped control member 298 has an internal stepped diameter providing a step 300 that at times abuts a disc valve 302. Valve 302 is lightly loaded by a spring 304 to seat against the end of a standpipe 306. The control member 298 is vented by a hole 308 connected to atmosphere by a vent 310 in housing 290. Control member 298 is urged by a spring 312 to seat disc valve 302 and prevent communication of servo vacuum in standpipe 306 to chamber 294. A screw adjustment 314 is provided for varying the force of spring 312. A second opposing spring 316 urges the diaphragm 292 and control member 298 rightwardly against the force of spring 312. It will be clear that by varying the screw adjustment 314, the balance of forces between the springs 312 and 316 and the vacuum in standpipe 306 will determine the level of vacuum in output chamber 294.

In operation, initially, the spring forces will be chosen and the adjustment made to screw adjustment 314 to provide the desired level of reduced servo vacuum in output chamber 294. When the vacuum rises above this level, the diaphragm 292 will be pulled leftwardly and continue to so move until the disc valve 302 is seated against the end of standpipe 306 by spring 304. Further leftward movement of diaphgram 292 will connect chamber 294 to the vent 310 between the control member step 300 and the disc valve 302. This venting will continue until the level of vacuum in chamber 294 again reaches the desired value.

The vacuum regulator 278 is identified as a "cold" regulator. As will appear more clearly later, this regulator is set to provide a constant low vacuum level to the distributor servo actuator 242 when the engine is operating below normal engine operating temperature levels so that the ignition timing will remain retarded from the normal setting. The regulator 280 is identified as an "idle" regulator and is set to provide a modified servo vacuum level to the servo actuator 242 that will provide a less retarded setting for operation during engine idle speed conditions for a warmed up engine.

The output from the cold regulator 278 passes through a line 318 to the solenoid opened vacuum control valve 282. This valve, like valve 284, has a solenoid, the armature of which constitutes a valve slidable within the housing between two positions. It normally is spring urged to one position to close the line 318 while connecting a servo vacuum line 320 through the vent line of the valve to a line 322 leading to vacuum valve 284. Both valves 282 and 284 have electrical contacts that are normally open. When energized to close the circuit, valve 282 opens and connects line 318 directly to line 322.

The output of the idle regulator 280 is connected by a line 326 to normally closed valve 284. When the solenoid of vacuum valve 284 is electrically energized, it will retract to block line 322 while interconnecting lines 326 and 324.

The solenoids of valves 282 and 284 receive current through wiring 327 that is connected as indicated to the "run" portion of the engine ignition circuit. The circuits are grounded through wires 328 and 329, respectively.

The servo vacuum or modified servo vacuum in line 324, as the case may be, is supplied to the servo chamber 250 of actuator 242 through a main line 325 past the flow restricting valve 288. The latter valve is simply a connector with a sized orifice or number of orifices to provide slow communication of vacuum on opposite sides of the valve. A bypass line 330 contains the one-way check valve 286. It operates to permit fast communication between the lines when the pressure on the upstream side of the valve is greater than the force of the pressure relief spring, not shown, of the valve and the pressure in the downstream portion of line 330. The overall operation of the ignition system under various temperature conditions of the engine will be described later.

The servo vacuum supplied to the vacuum regulators 278 and 280 and controlled by vacuum valves 282 and 284 is generated in line 306 as the output of a servo vacuum amplifier 308 (FIG. 1*b*). The latter is sensitive to manifold vacuum acting through a line 310 to control the admission of reservoir vacuum in a line 312 to the amplifier. Line 312 is connected to an auxiliary vacuum supply system 314 to be described later. The amplifier 308 includes a hollow housing 316 partitioned by two different diameter spaced annular flexible diaphragms 318 and 320 into a manifold vacuum chamber 322, a servo vacuum output chamber 324, and an atmospheric or vent chamber 326. A C-clamp type cage 328 is connected to the two diaphragms and receives a disc type valve 330 slidably mounted therein. A light spring 332 normally biases the disc valve towards diaphragm 320 to seat against the end of the supply line 312. Cage 328 has an opening, not shown, that connects chamber 326 with a vent 334 to the atmosphere.

In operation, the differential areas of the two diaphragms are chosen to provide a 9 to 1 force amplification. In this case, servo vacuum will be at a level of approximately 15", for example, for all manifold vacuum levels above 2", i.e., until the manifold vacuum drops below a level of 2". The servo vacuum then drops progressively with the drop in manifold vacuum from the 2" to zero levels. During the last 2" of manifold vacuum, therefore, the output servo vacuum in line 306 will vary in direct proportion to the drop in the manifold vacuum in line 310.

With higher than 2" manifold vacuum levels in chamber 322, the diaphragm 318 and cage 328 will be pulled rightwardly to move the disc valve 330 off the end of supply line 312. This will permit reservoir supply vacuum to flow to the output line 306. When the servo vacuum level becomes higher than 15" acting on the left side of diaphragm 320, the diaphragm will be flexed leftwardly, eventually permitting the disc valve 330 to seat and plug the servo vacuum line 312. Continued leftward movement by the higher vacuum in chamber 324 will move the cage 328 leftwardly to connect the servo vacuum in chamber 324 around the disc valve 330 to the vent line 334 to establish an equilibrium position at a 15" servo vacuum level. Minimum manifold vacuum (below 2"), such as during wide open throttle (WOT) operation, causes atmospheric pressure in the manifold line 310 coupled with the vacuum in chamber 324 to move the diaphragms 320 and 318 leftwardly to seat the disc valve 330 and bleed the output servo vacuum in chamber 324 to atmosphere.

The reservoir vacuum in inlet line 312 is supplied from a vacuum storage canister 336. The canister is charged with vacuum to a level of 15" either by the manifold vacuum in branch line 338 or the vacuum from a vacuum pump 340, whichever is higher. Whenever needed, vacuum pump 340 is electrically driven from the engine ignition "run" circuit, as indicated. The manifold vacuum line 338 is connected to canister 336 either through the inlet line 341 to vacuum pump 340 and then through output line 342, or directly through a line 344 past a one-way check valve 346. The output of vacuum pump 340 passes through a one-way check valve 350.

The output of canister 336 is connected by a line 352 to vacuum amplifier supply line 312. A branch line 354 triggers or actuates a vacuum opened microswitch 356 that is normally closed and electrically connected as indicated to the "run" part of the engine ignition circuit. The contacts (NC) of switch 356 normally are closed when less than 15" of vacuum, for example, acts on the switch, such as during engine starting, to connect the ignition circuit to the vacuum pump 340 through a relay 358. When the storage canister 336 becomes charged with 15" vacuum, the switch 356 will then open and break the circuit to the relay 358 and shut down the vacuum pump 340. The one-way check valve 350 prevents venting of the manifold vacuum through the vacuum pump.

The manifold vacuum in line 338 also charges a second storage canister 360 to supply manifold or reservoir vacuum through a line 362 to an engine coolant temperature responsive vacuum control valve 364. The latter is an on-off type valve placed in the engine coolant system so as to be sensitive to temperature changes therein. It is set so that below a predetermined coolant temperature level of, say, 95° F., for example, the valve will remain closed and prevent connection of manifold vacuum in line 362 to a line 366 leading to a pair of vacuum operated microswitches 368 and 370.

The microswitches 368 and 370 are of a construction similar to switch 356. Switch 368 in its unactuated position has a normally open (NO) electrical circuit to the EGR system, since below the desired operating temperature level, no EGR flow is desired. When the temperature increases to the desired level, the valve 364 opens to close microswitch 368 and electrically connect the ignition circuit (when in the "run" condition) to the solenoids of the EGR flow controlling vacuum valves, to be described later. The microswitch 370 in its unactuated or cold position normally connects the ignition "run" circuit to the solenoid opened ignition system vacuum valves 282 and 284 so that during cold engine operation, the valves will operate to retard the ignition timing. This will be described more clearly later. When the temperature rises enough to open valve 364, the switch 370 breaks the circuit to the ignition system so that the timing is no longer controlled by this switch.

FIGS. 1*b* and 1*a* show an interconnection between the conventional vehicle accelerator pedal 372 and the throttle valve 34. The connection operates so that with a cold engine, no EGR flow will occur. When the engine warms, the EGR flow rate will be established in a step-wise manner to sequentially provide a low EGR flow rate during engine idle and deceleration conditions of operation, and intermediate and high EGR flow rates as a function of load and throttle valve positions. The intermediate and high EGR rate flows are established by means of a pair of microswitches 373 and 374 actuated sequentially upon depression of the accelerator pedal 372 and opening of the throttle valve 34 to intermediate and high load positions.

More specifically, a link 375 fixed to the throttle valve shaft 376 carries a pivot pin 378 at one end of the link. The pivot pin 378 also supports a lever 380 (FIG. 1*b*) pivoted at 382, and is pivotally connected to the accelerator pedal 372, as indicated. The shaft 382 of lever 380 mounts a pair of cam shaped actuators that include an intermediate EGR cam 384 and a high EGR cam 386. The cams are contoured as shown to provide nearly constant radius curved surfaces 388 and 390 and lesser radii or recessed areas 392 and 394. The recessed areas cooperate with the flexible switch finger elements 396 and 398 of the pair of intermediate EGR and high EGR flow rate microswitches 373, 374. The switches in this case are adapted to be actuated in succession in response to a continued depression of the accelerator pedal 372 to predetermined angles, to provide a stepwise change in the flow rate of the EGR gases, in a manner to be described.

The microswitches 373, 374 in this case normally are maintained in the actuated stage, as shown. As such, the electrical circuit through switch 373 is completed between a common (C) ground wire 404 and the normally open (NO) contact. The NO contact is connected by wire 329 through the solenoid opened ignition system vacuum valve 284 in FIG. 1*c* to the engine ignition "run" circuit. The actuated position of microswitch 373 breaks the connection between the ground wire 404 and the normally closed (NC) contact that is connected by wire 408 to a normally closed, solenoid opened, two position vacuum control valve 410. The closed (NC) position of valve 410 connects a vent line 411 of the valve to a line 412. When the cam 384 is rotated by the accelerator pedal 372 to a position aligning the recess 392 with the finger element 396, then switch 373 opens and makes and breaks the circuits as indicated. The solenoid of valve 410 is then energized through a wire 413 connected through microswitch 368 to the ignition "run" circuit. Valve 410 then opens, blocking vent line 411 while connecting manifold vacuum in line 274 to line 412. Line 412 is connected both to the intermediate EGR servo motor 36 (FIG. 1*a*) and to the regulator intermediate EGR servo motor 190 (FIG. 1*e*).

The manifold vacuum is also connected to a normally closed solenoid opened low EGR rate vacuum control valve 414 that also is electrically connected by wire 413 to the vacuum operated microswitch 368. In its closed position, valve 414 blocks flow of manifold vacuum in line 274 to a line 415 while connecting line 415 to an atmospheric vent line 416 in valve 414. When the engine operating temperature is normal or above, microswitch 368 is closed by vacuum in line 366 to close the normally open (NO) electrical circuit to vacuum valve 414 and open the latter valve. Manifold vacuum then is connected to line 415 while the vent line 416 is blocked. Line 415 is connected both to the low rate EGR servo motor 35 and also to the regulator low EGR rate servo motor 178.

The microswitch 374 is similar to microswitch 373, and is normally moved by the accelerator pedal operated cam 386 to the actuated position. The center contact (C) is connected to ground through a wire 417 and a temperature responsive switch indicated. The normally closed (NC) contact of microswitch 374 is now open and breaks the connection through a wire 418 to the normally open (NO) contact of a normally closed, solenoid opened vacuum control valve 419. In its closed position, valve 419 blocks the connection of servo vacuum in line 306 to a high rate EGR flow vacuum line 420, while connecting line 420 to atmosphere through a vent line 422 in valve 419.

When cam 386 is rotated by the accelerator pedal to a position aligning the recess 394 with the finger element 398 of switch 374, then the switch becomes deactivated. Switch 374 then opens and connects the ground (C) wire 417 to the normally closed contact (NC) of switch 374 to establish the electrical circuit through wires 418 and 413 and microswitch 368 to the solenoid of high EGR rate vacuum valve 419. The latter valve then opens to connect servo vacuum line 306 to the high EGR flow rate vacuum line 420, while blocking vent line 422. Line 420 is connected to the high rate EGR servo motor 36 and also to regulator high rate EGR servo motor 156. It will be noted that the servo vacuum in line 306 is also connected in parallel flow relationship to the WOT power enrichment servo motor 186 (FIG. 1*e*) and through a line 424 to a vacuum operated microswitch 426 (FIG. 1*a*).

The exhaust system in FIG. 1*a* includes an EGR overtemperature protection switch 428, and a backpressure control valve 430 to control the diversion of gases into EGR passage 30. The valve 430 is biased by a servo spring, not shown, to the open position shown, and is moved to the closed position by a vacuum servo 432. Servo 432 is actuated by reservoir vacuum in line 312 admitted to a line 434 when a normally closed (NC) solenoid opened vacuum control valve 436 is energized. The valve 436 has a normally open (NO) contact connected by wiring 440, 442 to contacts of an EGR overtemperature protection circuit control 438. The control has other contacts indicated that are connected to the "run" position of the engine ignition circuit by wiring 444, connected to the temperature responsive switch 428 by wiring 448, and connected to the normally open vacuum operated microswitch 426 by wiring 450.

The switch 426 closes whenever the servo vacuum in line 424 is above 5" to close the backpressure valve 430 to assure diversion of enough EGR gases into passage 30 to satisfy the EGR flow schedule. At WOT conditions, however, when the servo vacuum drops below 5", valve 430 opens to obtain maximum air (oxygen) intake for maximum performance and efficiency. At this time, the switch 426 reverts to the normally open circuit condition, breaking the connection from the ignition circuit to the solenoid of vacuum valve 436. Closure of valve 436 vents the line 434 to atmosphere through a vent line 451 of valve 436 and permits the spring, not shown, of servo 432 to open valve 430.

Valve 430 will also move towards an open position in response to the EGR gases in passage 30 reaching a certain temperature level. When this occurs, switch 428 breaks the electrical circuit to valve 436, which then closes and bleeds line 434 so that the servo spring of servo 432 will cause the valve 430 to open.

Before proceeding to the operation, it should be noted that the engine would contain a conventional automatic cold enrichment mechanism, not shown. It would include a temperature sensitive bimetal coil operably connected to a fast idle cam mechanism that would project into the path of a throttle valve stop. This would prevent the throttle valve 34 from closing during cold engine operation by amounts that would be determined by the degree of contraction or expansion of the bimetal coil in response to the attainment of scheduled temperature levels. The details of construction of such a mechanism are not given here since they are believed to be unnecessary for an understanding of the invention. In brief, during a cold start, the fast idle cam would prevent the throttle valve from closing and will maintain it open by an amount that increases progressively with decreases in temperature level. This is necessary to provide more fuel and more power to overcome the increased friction forces to keep the engine running. As the engine warms, the bimetal would unwind to permit a progressive closing of the throttle valve to its normal idle speed position as the temperature increases.

During cold engine operation below 75° F., the movement of the air/fuel ratio regulator fuel enrichment lever 132 is controlled by the temperature compensation servo motor 170 that attempts to maintain the air/fuel ratio at a level of approximately 20 to 1, for example. Servo motor 170 is connected by a line 460 to reservoir vacuum at 15" in line 312 past a vacuum storage canister 462 (FIG. 1*a*) and a spring closed, solenoid opened vacuum control valve 464. The latter in its normally unenergized, closed (NC) position vents line 460 to atmosphere past a thirty second vacuum time delay valve 466, for a purpose to be later described. The valve 464 has normally open (NO) electrical contacts that are energized from the engine ignition "run" circuit, as indicated, to open valve 464. The valve then connects the reservoir vacuum in line 312 to line 460 while closing the vent line 468. The ground circuit for the solenoid of valve 464 is controlled by the state of actuation or non-actuation of microswitch 370, as will become clear later.

The start of a hot engine also requires an open throttle. With less dense air, opening of the throttle valve will lean the mixture charge. The mechanism for accomplishing this is shown in FIG. 1*b* at 470 and labeled a hot start throttle positioner. More particularly, a servo 472 when actuated by manifold vacuum in line 474 pulls downwardly a rod 476 connected by a link 478 to the throttle valve shaft 376. Manifold vacuum in line 362 is connected to line 474 past a spring closed, solenoid opened vacuum control valve 480. It has a vent line 482 normally connected to line 474 in the closed or unenergized position of valve 480. The valve solenoid is energized by a connection to the "start" position of the engine ignition circuit, as indicated, to open valve 480 and close vent line 482. A time delay vent valve 484 is included in line 482. As soon as the engine ignition circuit attains the "run" condition, the electrical circuit to valve 480 is broken and valve 480 again closes to block line 362 and vent line 474. The time delay acts as a dashpot action to slowly return the throttle valve 34 to idle position.

The starting of a hot engine, therefore, immediately provides opening of the throttle valve to a position greater than the normal idle speed throttle position so as to provide greater air flow and proportionately less fuel flow at this time.

OPERATION

Before the engine is started, the operator would first depress the accelerator pedal 372 to the floorboard. This would release the fast idle cam of the cold enrichment system and open the throttle valve. If the engine is cold, release of the accelerator pedal would "set" the throttle valve at a position more open than the hot start throttle position provided by servo 472. This results in a larger flow of air/fuel mixture to the engine than during warm engine starting conditions, to overcome the increased frictional forces.

Movement of the vehicle ignition key by the vehicle operator to the "start" position then causes the following to occur. The ignition circuit first energizes the fuel supply system in FIG. 1*d* to close the two-way solenoid valve 80, start the fuel supply pump 62, and open the three-way solenoid valve 68. The pump 62 will then supply fuel at 100 psi through the bypass line 66 to prime the injection pump 38 and line 49 and to supply the cold start fuel injector 74 through a line 72. The temperature valve 76 at this time, if the temperature is below the set level, will close the electric circuit to cold start injector 74 so that it will then inject fuel directly into induction passage 10.

At the same time, if the throttle valve has not already been located in the open position by the first idle cam, the solenoid of hot start vacuum control valve 480 is energized to open the valve and admit manifold vacuum in line 362 generated during engine cranking to line 474 and servo 472 to pull the throttle valve 34 to the hot start position Once the engine has been started, release of the ignition key to the "run" position will de-energize the starting circuit causing the fuel supply system two-way solenoid valve 80 to open and the three-way solenoid valve 68 to close, dropping the output fuel pressure from supply pump 62 to the normal 28 psi level. The cold start fuel injector 74 (FIG. 1*a*) will be de-energized by breaking of the circuit to the temperature switch 76. The hot start throttle positioner vacuum control valve 480 will close to slowly bleed servo line 474 through the delay valve 484 to gradually permit closure of the throttle valve 34 to its normal idle speed position, if the throttle valve is not controlled by the fast idle cam.

When the engine is running cold, the system is conditioned for zero EGR flow and a retarded ignition timing setting. This is accomplished as follows. Microswitch 370 (FIG. 1*b*) will be in its unactuated NC position. This completes a circuit from the ignition "run" circuit through the contacts of valve 464, microswitch 370, and wire 328 to the ignition system vacuum control valve 282 in FIG. 1*c*. Energization of valve 282 opens it to block line 320 and connects the modified servo vacuum in line 318 from the cold vacuum regulator 278 to the vacuum valve 284. The circuit to valve 284 is broken. Therefore, the valve is closed and the vacuum in line 322 passes through the vent line of valve 284 to line 324 and through the vacuum delay valve 288 to servo vacuum chamber 250. This coupled with the manifold vacuum in chamber 252 will move the rod 257 leftwardly to a predetermined position providing the desired cold engine retarded ignition timing setting. The timing will then vary only as a function of changes in manifold vacuum, so long as it is above a 2" level.

The energization of vacuum control valve 464 (FIG. 1*a*) opens it to connect reservoir vacuum in line 312 to the storage canister 462 and through line 460 to the temperature compensator servo motor 170. The servo motor retracts its rod 168 to pivot the lever 162 and permit spring 144 to cam the walking beam 140 in a direction to slightly move the fuel enrichment lever 132 in a fuel enrichment direction. While the servo motor 170 is "on" as long as the engine is cold, its usefulness essentially is only during the transitional period from cold to warm engine operation to gradually change or richen the air/fuel ratio for a period of 30 seconds until the cold EGR gases warm up. The 30 second delay occurs when the vacuum control valve 464 shuts and line 460 and reservoir 462 are vented slowly (30 seconds) to atmosphere through the vacuum delay valve 466. The cold EGR pipe initially will cool the EGR gases. The increased fuel during this 30 second bleed down compensates for the increased density of the air, therefore, at this time. At the end of the 30 second period, the EGR gases will have warmed and the volume of air will be reduced to its scheduled level.

The WOT power enrichment servo 186 is stroked at all times by servo vacuum in line 306 to move the bellcrank lever 142 clockwise. This will move the walking beam to move the enrichment lever in a fuel richening direction to provide a cold engine 16 to 1 air/fuel ratio. If the accelerator pedal 372 were floored at this time, servo vacuum would decay to zero. This would relax the WOT servo 186 and permit spring 188 to move rod 184 away from bellcrank leg 180. The spring 144 could then move the walking beam upwardly to move lever 132 to richen the air/fuel ratio to 12 to 1, for example, which would be desirable at WOT conditions.

The reservoir vacuum in line 312 as maintained at a level of 15" either by the vacuum pump 340 or the manifold vacuum in line 338. The reservoir vacuum is the input to the vacuum amplifier 308 having an output servo vacuum of approximately 15" so long as the manifold vacuum remains above a 2" level. The back pressure control valve 430 is closed when the servo vacuum closes microswitch 426 to energize vacuum valve 436. This opens valve 436 to apply the reservoir vacuum in line 434 to the servo 432.

The servo vacuum in line 306 also is applied to the WOT power enrichment servo 186 previously mentioned. This will retract the servo rod 184 to move leg 180 of the bellcrank lever 142 and air/fuel ratio controller enrichment lever 132 to a lean enrichment position, as mentioned before.

No EGR will flow at this cold setting because the electrical circuit is broken between the microswitch 368 and the three vacuum control valves, 410, 414, and 419 that block flow of vacuum to the various EGR and regulator servo motors. Therefore, at this time, the air/fuel ratio of the mixture charge to the engine will be controlled by changes in intake manifold vacuum in line 126, modified only by the combined action of the temperature compensation servo 170 and the WOT power enrichment servo 186 acting on the walking beam 140 and fuel enrichment lever 132.

As the throttle valve 34 is rotated off idle, the ignition timing will be controlled as a function of the change in manifold vacuum in actuator chamber 252, since the servo vacuum level in chamber 250 will remain essentially constant from the cold fixed vacuum regulator 278. For all throttle positions other than WOT, therefore, the air/fuel ratio will be maintained at approximately 16 to 1.

At WOT conditions, the backpressure control microswitch 426 will be deactivated by the drop in servo vacuum below 5" to break the circuit to the vacuum valve 436. The vacuum valve then closes and vents the servo supply line 434 allowing the servo spring to open the back pressure valve 430. This will reduce the exhaust back pressure and increase engine efficiency at this time. At the same time, the drop of manifold vacuum to a level below 2" will gradually bleed the vacuum from WOT power enrichment servo 186 causing a gradual movement of its rod 184 rightwardly by a spring 188 to permit the bellcrank lever leg 180 to move. However, servo motor 176 still maintains an air/fuel ratio of 16 to 1.

When the engine warms to its normal operating temperature level, the temperature valve 364 (FIG. 1*b*) opens to admit storage canister or manifold vacuum to both microswitches 368 and 370. The electrical circuit controlled by microswitch 368 then is completed or activated while that controlled by the microswitch 370 is broken or deactivated. The effect of this is to break the electrical circuit through line 328 both to the ignition system vacuum valve 282 and vacuum control valve 464, while completing the circuit through line 329 to ignition system valve 284. The latter is accomplished through microswitch 368, intermediate EGR microswitch 373, and wire 406.

The closing of vacuum valve 464 slowly vents the temperature compensation servo motor 170 through the vacuum delay valve 461, allowing the servo spring 171 to move the cam lever 162 to a position temporarily establishing a richer air/fuel ratio until the EGR gases warm up. Closing of the ignition system vacuum valve 282 now connects servo vacuum in line 320 through the de-energized closed valve 282 to line 322 and to the now closed vent of valve 284, where further flow is blocked. The open valve 284, however, connects the modified servo vacuum in line 326 to line 324 and through delay valve 288 to chamber 250 of distributor actuator servo 242. The changed servo vacuum level will move the servo actuator rod 257 leftwardly an increment additional to that already established by the manifold vacuum in chamber 252 to establish the ignition timing for idle speed operation.

The energization of the microswitch 368 also has now completed the circuit from the ignition circuit to each of the three EGR solenoid opened vacuum valves 410, 414, and 419. This immediately opens the low EGR flow vacuum valve 414 to connect manifold vacuum in line 274 to line 415 to energize the low rate EGR servo 35 and the regulator low EGR rate servo 178. This rotates open the EGR valve by a predetermined number of degrees to establish the low EGR flow rate scheduled. At the same time, the regulator EGR servo motor 178 moves the bellcrank lever 142 to raise the pin 146 and change the position of the fuel enrichment lever 132. This will move the fuel lever 104 to pivot the fuel pump output lever 50 to decrease the fuel flow to compensate for the amount of EGR flow scheduled to maintain the air/fuel ratio selected constant.

The intermediate EGR and high EGR vacuum valves 410 and 419, however, will not open at this time because the controlling microswitches 373 and 374 are in an actuated position by the cams 384 and 386 to break the electrical circuits to the valves. This actuated position of the microswitch 373 completes the circuit to the ignition system vacuum valve 284 to open the valve as described above.

When the accelerator pedal 372 is depressed to a position where the intermediate EGR cam 388 aligns the recess 392 with the microswitch contact 396, the microswitch will change to its unactuated condition. This will break the circuit through line 329 to the ignition system vacuum control valve 284, closing the same. This will now permit servo vacuum at full value to flow through the vent lines of the closed valves 282 and 284 and through delay valve 288 to the servo vacuum chamber 250 of the distributor actuator. This will provide an additional advance of ignition timing when the throttle is conditioned for beyond idle speed operation.

Simultaneously, the intermediate EGR microswitch 373 will now establish a circuit to the intermediate EGR vacuum valve 410 opening the same and allowing manifold vacuum to flow to the intermediate rate EGR vacuum line 412. The intermediate rate EGR servo 36 now is actuated and moves the link 230 upwardly to pivot the EGR valve 32 to a second open position providing an intermediate flow rate of EGR gases. This same vacuum is applied to the regulator intermediate EGR servo motor 190, which pulls down the bellcrank lever leg 196 to again move the fuel enrichment lever 132. This results in the fuel lever 104 pivoting the fuel pump output lever 50 in a direction to decrease further the fuel in proportion to the increased EGR flow to attempt to maintain the constant air/fuel ratio previously established.

Continued depression of the accelerator pedal 372 eventually rotates the high EGR cam 386 to a position where the microswitch contact 398 moves into the recess 394 of the cam. The microswitch 374 then returns to its unactuated position completing the circuit between the microswitch 368 and the high EGR vacuum control valve 419. This opens the valve 419 to connect servo vacuum in line 306 to the high rate EGR vacuum line 420. The high rate EGR servo motor 37 then pulls the EGR valve link 222 upwardly to establish a high rate of flow of EGR gases. At the same time, the regulator high rate EGR servo motor 156 is actuated to pull down one end of the walking beam 140 and move the fuel enrichment lever 132 to a lean out position. This again rotates the fuel control lever 104 to move the fuel pump output lever 50 to again decrease the fuel flow to compensate for the increased EGR flow. It will be noted that the EGR servo motors 35, 36, and 37 and the regulator servo motors 178, 190 and 156 are operated in succession and are cumulative.

Finally, when the accelerator pedal 372 is depressed to its wide open throttle valve position, the manifold vacuum decreases immediately to below a 2" level. The effect of this is to begin a decrease in the servo vacuum level from 15" gradually toward zero resulting in a gradual retarding of the ignition timing and a gradual termination of EGR flow as well as a movement of the air/fuel ratio controller to the fuel enrichment position. That is, a drop in manifold vacuum to essentially zero causes the spring 268 in the ignition system distributor actuator manifold vacuum chamber 252 to move the rod 257 to the right towards an ignition retard setting direction. The servo vacuum in chamber 250 slowly decays towards a zero level and, therefore, also slowly permits its spring 266 to move the rod 257 rightwardly. The drop in manifold vacuum and servo vacuum causes the WOT power enrichment servo to move rightwardly and permit the walking beam spring 144 to pull upwardly. This will move lever 132 to a fuel enrichment position. The drop in vacuum levels also causes the servo springs of each of the high, intermediate, and low rate EGR servo motors 35, 36, and 37 to extend the rods connected to them and close the EGR valve 32 as well as move the air/fuel ratio controller linkage and lever 132 towards a fuel enrichment position to pivot the injection pump control lever 50 to increase fuel output to a maximum. Therefore, even though the vacuum valves controlling the EGR system are conditioned to permit EGR flow, the vacuum level for actuating the servo motors is at this time essentially zero and EGR flow, therefore, is terminated. At the same time, the drop in servo vacuum below 5" opens backpressure valve microswitch 426, which then breaks the circuit to vacuum valve 436. This closes the valve and vents line 434 to permit the spring of servo 432 to open backpressure valve 430. More power is then assured.

From the above, it will be clear that the invention provides a fuel injection control system that establishes in a step-wise manner different distinct EGR flow rates and ignition timing and modifies the action of the air/fuel controller to change the fuel injection pump fuel output to compensate for EGR flow in order to maintain an established air/fuel ratio to the mixture charge flowing to the engine. It will also be seen that the control system compensates for wide open throttle conditions of operation by terminating EGR flow, retarding ignition timing, and maximizing fuel pump flow. It will further be seen that during cold engine operation, EGR flow is prevented and the engine ignition timing is conditioned for a retarded setting operation to provide more efficient operation and better vehicle driveability.

While the invention has been shown and described in its preferred embodiment, it will be clear to those skilled in the arts to which it pertains that many changes and modifications may be made thereto without departing from the scope of the invention.

We claim:

1. A fuel injection control system for an internal combustion engine of the spark ignition type including an air-gas induction passage open at one end to air at ambient pressure level and connected at its other end to the engine combustion chamber to be subject to manifold vacuum changes therein, a throttle valve rotatably mounted for movement across the passage to control the air-gas flow therethrough, an exhaust gas recirculation (EGR) system including EGR passage means connecting engine exhaust gases to the induction passage above the closed position of the throttle valve, an EGR flow control valve mounted in the EGR passage means for movement between open and closed positions to control the volume of EGR gas flow, an engine speed responsive positive displacement type fuel injection pump having a fuel flow output to the combustion chamber that varies as a function of changes in engine speed to match fuel flow and mass air flow through the induction system of the engine over the entire speed and load range of the engine to maintain the intake mixture ratio of air to fuel constant, an air/fuel ratio regulator operably connected to the pump and movable in response to changes in intake air quantity to vary the fuel output of the pump to maintain a constant air/fuel mixture ratio, and control means for modifying the movement of the regulator as a function of EGR flow conditions to change the pump output flow rate to at times maintain the constant air/fuel ratio and at other times to provide an air/fuel ratio other than the constant air/fuel ratio.

2. A control system as in claim 1, including an operator movable engine accelerator pedal connected to the throttle valve for moving the throttle valve, the control means including a first EGR vacuum motor connected to the EGR valve to move the same at times and a first regulator vacuum motor connected to the regulator to move the regulator at times in response to operation of the first EGR vacuum motor to control the pump output, a source of vacuum, vacuum passage means interconnecting the source and vacuum motors, and EGR flow scheduling valve means in the passage means operably interconnected to the accelerator pedal to be moved in response to movement of the pedal.

3. A control system as in claim 1, the control means including a plurality of EGR vacuum motors individually connected to the EGR valve for effecting different openings of the EGR valve and a like number of regulator vacuum motors connected to the regulator for moving the regulator, the vacuum motors operating in pairs whereby actuation of one EGR vacuum motor effects operation of a corresponding connected regulator vacuum motor to move the regulator to correct fuel pump output flow for the variance in EGR flow rate.

4. A control system as in claim 2, the first EGR vacuum motor having a stroke effecting a controlled opening of the EGR valve to establish a low rate of EGR flow, and second and third EGR vacuum motors also operably connected to the EGR valve and having strokes establishing greater intermediate and high EGR flow rates, respectively, when operable, and second and third regulator vacuum motors operably connected both to the regulator and second and third EGR vacuum motors, respectively, for adjusting the fuel pump output flow rate in response to the change in EGR flow rate.

5. A control system as in claim 3, including means for rendering operable the EGR vacuum motors sequentially to establish progressively higher EGR flow rates as a function of increasing accelerator pedal depression.

6. A control system as in claim 5, including lost motion means connecting the EGR vacuum motors to the EGR valve permitting movement of the EGR valve a distance greater than the strokes of some of the vacuum motors alone.

7. A control system as in claim 1, including an operator movable engine accelerator pedal operably connected to the throttle valve for moving the throttle valve, the control means including a plurality of EGR vacuum motors having different strokes and each individually connected to the EGR valve for individual movement of the EGR valve by varying degrees to establish overall essentially low, intermediate and high EGR flow rates, and a corresponding number of regulator vacuum motors each operably connected to the regulator for individually adjusting the fuel pump output flow rate as a function of the individual adjustment of EGR flow, a source of vacuum, passage means connecting the source to the vacuum motors, EGR flow rate scheduling valve means in the passage means movable to control vacuum flow and thereby the operability of the vacuum motors as a function of movement of the accelerator pedal and throttle valve, and means operably connecting the scheduling valve means to the accelerator pedal and throttle valve.

8. A control system as in claim 7, the scheduling valve means including a flow, no-flow type vacuum flow control valve in the passage means to each of the EGR vacuum motors to control vacuum flow and establish the low, intermediate and high EGR flow rates, and means for selectively moving the control valves to selectively establish the various EGR flow rates.

9. A control system as in claim 8, the last mentioned means including cam means operably connected to and rotated by the accelerator pedal and engageable with the control valves.

10. A control system as in claim 8, the control valves being solenoid opened, the system including an electrical circuit including switch means actuated by movement of the accelerator pedal and electrically connected to the solenoid opened valves to energize the same moving the control valve to the alternate flow position.

11. A control system as in claim 1, including an operator movable vehicle accelerator pedal operably connected by actuator means to the throttle valve for opening the valve upon depression of the pedal, and control means interconnecting the actuator means and EGR valve for effecting opening of the EGR valve as a predetermined function of depression of the accelerator pedal.

12. A control system as in claim 11, including EGR valve shut-off means for effecting closing of the EGR valve in response to depression of the accelerator pedal to a near wide open throttle position.

13. A control system as in claim 10, including a vacuum pump, a vacuum reservoir supplied by the vacuum pump, and control means including passage means operably connecting the vacuum in the reservoir to various ones of the vacuum motors for selectively operating the various ones of the motors at times by a constant vacuum level independent of manifold vacuum changes.

14. A control system as in claim 1, the control means including a plurality of EGR servos individually connected to the EGR valve for moving the EGR valve to various openings to establish different EGR flow rates, and a corresponding number of air/fuel ratio regulator servos individually connected to the corresponding EGR servos and to the regulator for providing adjustment of the regulator to modify the pump output fuel flow in correlation with the change in EGR flow rate.

15. A control system as in claim 1, the control means including servo means connected both to the EGR valve and to the regulator providing a step function flow of EGR gases and a corresponding step function modification of the movement of the regulator to correct the fuel pump fuel flow output in a step function manner.

16. A control system as in claim 14, the plurality of EGR servos and corresponding regulator servos being sequentially operated to provide increasing EGR flow and increasing regulating of fuel flow to compensate for the EGR flow.

17. A control system as in claim 1, including means operable during engine operation below a predetermined temperature level to render the EGR system inoperative.

18. A control system as in claim 1, the control means including at least a pair of EGR servo motors connected to the EGR valve and sequentially operated to provide a step function movement of the EGR valve and a step function control of the EGR flow.

19. A control system as in claim 1, the control means including means rendering the EGR system inoperable to control the regulator below a predetermined engine operating temperature level; and other means providing a step function control of the EGR flow and a step function control of the regulator above the predetermined engine operating temperature level.

20. A control system as in claim 1, including an engine ignition timing control device movable to vary the engine timing, the control means including means interconnecting the timing control device and the EGR valve for varying the timing as a function of change in EGR flow.

21. A control system as in claim 20, including means responsive to operation of the engine below a predetermined operating temperature level to condition the timing control device for one mode of operation, and responsive to operation of the engine at an operating temperature above the predetermined level to condition the ignition timing for a different mode of operation.

22. A control system as in claim 1, including means responsive to operation of the engine below a predetermined temperature level for rendering the control means inoperative to control the regulator as a function of EGR flow and moving the throttle valve to an engine cold start open position, and means responsive to operation of the engine above the predetermined temperature level for moving the throttle valve to a different position and conditioning the regulator for movement in response to EGR flow.

23. A control system as in claim 1, the control means including first and second EGR servos connected individually to the EGR valve and operable sequentially to move the EGR valve open to establish different EGR flow rates, and first and second regulator servos connected individually to the regulator and interconnected with the first and second EGR servos, respectively, for sequentially modifying the movement of the regulator in response to open movement of the EGR valve.

24. A control system as in claim 23, the first and second EGR servos and the first and second regulator servos each having a lost motion connection to the EGR valve and regulator, respectively, permitting a limited movement of the EGR valve relative to each EGR servo and a limited movement of the regulator relative to each regulator servo.

25. A fuel injection control system for an internal combustion engine of the spark ignition type including an air-gas induction passage open at one end to air at ambient pressure level and connected at its other end to the engine combustion chamber to be subject to manifold vacuum changes therein, a throttle valve rotatably mounted for movement across the passage to control the air-gas flow therethrough, an exhaust gas recirculation (EGR) system including EGR passage means connecting engine exhaust gases to the induction passage above the closed position of the throttle valve, an EGR flow control valve mounted in the EGR passage means for movement between open and closed positions to control the volume of EGR gas flow, an engine speed responsive positive displacement type fuel injection pump having a fuel flow output to the combustion chamber that varies as a function of changes in engine speed to match fuel flow and mass air flow through the induction system of the engine over the entire speed and load range of the engine to maintain the combustion chamber intake mixture ratio of air to fuel constant, an air/fuel ratio regulator operably connected to the pump and movable in response to changes in intake air as indicated by changes in intake manifold vacuum connected thereto to vary the fuel output of the pump to maintain a constant air/fuel mixture ratio, and control means for modifying the movement of the regulator as a function of EGR flow conditions to change the pump output flow rate to at times maintain the constant air/fuel ratio and at other times to provide an air/fuel ratio other than the constant air/fuel ratio, the control means including first and second and third sequentially operated EGR servos and corresponding first and second and third sequentially operated air/fuel ratio regulator servos, lost motion linkage means connecting each of the EGR servos separately to the EGR valve for separate actuation thereof to open the EGR valve by different degrees in a step-wise manner to establish in sequence low, intermediate and high rates of flow of EGR gases, other lost motion means connecting each of the regulator servos individually to the regulator to modify the regulator movement in a step-wise manner corresponding to the movement of the corresponding EGR valve to effect a step-wise change in the fuel pump fuel flow, and temperature sensitive means responsive to engine operating temperature levels for modifying the action of the EGR servos and regulator servos to provide different mixture air/fuel ratios during engine operation below a predetermined temperature level and still other air/fuel ratios during engine operation above the predetermined temperature level.

26. A control system as in claim 25, the servos being vacuum controlled, a source of vacuum, vacuum circuit means interconnecting the first and second and third EGR servos to the first and second and third regulator servos, respectively, the temperature sensitive means including on-off vacuum control valves in the circuit means movable to an off position to block the flow of vacuum from the source to the servos below the predetermined temperature and movable above the predetermined temperature level to an on position permitting the flow of vacuum to the servos.

27. A control system as in claim 26, the low flow rate first EGR servo and corresponding first regulator servo being supplied vacuum at all times during engine operation above the predetermined temperature level, and other means operable in response to predetermined openings of the throttle valve to move the associated on-off vacuum control valves to open the vacuum circuit means to the second intermediate flow rate EGR servo and second regulator servo and to open the vacuum circuit to the third high rate EGR servo and third regulator servo.

28. A control system as in claim 27, the other means including means moving the on-off valves open in sequence as a function of increased throttle valve opening.

29. A control system as in claim 27, including means operable in response to operation of the EGR system above a predetermined temperature level to divert EGR gases from the EGR passage means for replacement of EGR gases by air in the air-gas intake charge to the combustion chamber to cool the EGR system.

30. A control system as in claim 26, the temperature sensitive means including an engine coolant temperature sensitive on-off valve in the vacuum circuit means, an electrical circuit connecting a source of electrical energy to the on-off valves, the on-off valves being solenoid opened, and further vacuum controlled valve means in the vacuum circuit to the solenoid opened valves, movement of the temperature sensitive valve to one position effecting operation of the vacuum controlled valve means in one mode to complete the electrical circuit to the solenoid opened valves, movement of the temperature sensitive valve to an alternate position effecting operation of the vacuum controlled valves in an alternate mode to break the electrical circuit to the solenoid opened on-off valves to thereby control the flow of vacuum to the EGR and regulator servos.

* * * * *